US006750187B2

(12) United States Patent
Alam et al.

(10) Patent No.: US 6,750,187 B2
(45) Date of Patent: Jun. 15, 2004

(54) CLEANING COMPOSITION

(75) Inventors: Elizabeth Ann Alam, West Chester, OH (US); Chandrika Kasturi, Cincinnati, OH (US); Brian Xiaoqing Song, West Chester, OH (US); Frank William DeNome, Cincinnati, OH (US); Brenda Frances Bennie, Cramlington (GB); Mairi Campbell, Newcastle upon Tyne (GB); James Iain Kinloch, Cramlington (GB); Neha Kapur, Newcastle (GB)

(73) Assignee: The Proter & Gamble Company, Cincinnati, OH (US)

( * ) Notice: Subject to any disclaimer, the term of this patent is extended or adjusted under 35 U.S.C. 154(b) by 160 days.

(21) Appl. No.: 09/906,491

(22) Filed: Jul. 16, 2001

(65) Prior Publication Data

US 2002/0035051 A1 Mar. 21, 2002

(30) Foreign Application Priority Data

Jul. 19, 2000 (WO) ..... PCT/US00/19619
Jul. 25, 2000 (WO) ..... PCT/US00/20255
Dec. 21, 2000 (WO) ..... PCT/US00/34909

(51) Int. Cl.[7] ..... C11D 3/44

(52) U.S. Cl. ..... 510/221; 510/220; 510/224; 510/504; 510/506; 510/514; 134/26

(58) Field of Search ..... 510/221, 220, 510/224, 504, 506, 514, 417, 505, 424, 365; 134/26, 40

(56) References Cited

U.S. PATENT DOCUMENTS

| | | | | | |
|---|---|---|---|---|---|
| 4,101,457 | A | * | 7/1978 | Place et al. | 510/226 |
| 5,102,573 | A | | 4/1992 | Han et al. | |
| 5,929,007 | A | | 7/1999 | Feng | |
| 6,180,578 | B1 | * | 1/2001 | Hemm et al. | 510/225 |
| 6,274,538 | B1 | * | 8/2001 | Addison | 510/224 |

FOREIGN PATENT DOCUMENTS

| | | |
|---|---|---|
| JP | A-10 017 900 | 1/1998 |
| JP | A-11 117 000 | 4/1999 |
| WO | WO 94/28108 | 12/1994 |

* cited by examiner

*Primary Examiner*—Gregory Webb
(74) *Attorney, Agent, or Firm*—Kevin L. Waugh

(57) ABSTRACT

A method of removing cooked-, baked-, or burnt-on food soil from cookware and tableware comprising delivering a plurality of compositions including at least one organic solvent composition into the same or different cycles of an automatic dishwashing machine and washing the soiled cookware/tableware in the resulting solvent-containing wash liquor. The method includes the storage and delivery of organic solvent compositions and dishwashing detergent composition from multi-compartment containers. The method provides excellent removal of stubborn soils which are very difficult to remove in a conventional automatic dishwashing process.

49 Claims, No Drawings

CLEANING COMPOSITION

TECHNICAL FIELD

The present invention is in the field of dishwashing, in particular it relates to dishwashing methods suitable for the removal of cooked-, baked- and burnt-on soils from cookware and tableware.

BACKGROUND OF THE INVENTION

Cooked-, baked- and burnt-on soils are amongst the most severe types of soils to remove from surfaces. Traditionally, the removal of cooked-, baked- and burnt-on soils from cookware and tableware requires soaking the soiled object prior to a mechanical action. Apparently, the automatic dishwashing process alone does not provide a satisfactory removal of cooked-, baked- and burnt-on soils. Manual dishwashing process requires a tremendous rubbing effort to remove cooked-, baked- and burnt-on soils and this can be detrimental to the safety and condition of the cookware/tableware.

The use of cleaning compositions containing solvent for helping in the removal of cooked-, baked- and burnt-on solids is known in the art. For example, U.S. Pat. No. 5,102,573 provides a method for treating hard surfaces soiled with cooked-on, baked-on or dried-on food residues comprising applying a pre-spotting composition to the soiled article. The composition applied comprises surfactant, builder, amine and solvent. U.S. Pat. No. 5,929,007 provides an aqueous hard surface cleaning composition for removing hardened dried or baked-on grease soil deposits. The composition comprises nonionic surfactant, chelating agent, caustic, a glycol ether solvent system, organic amine and anti-redeposition agents. WO-A-94/28108 discloses an aqueous cleaner concentrate composition, that can be diluted to form a more viscous use solution comprising an effective thickening amount of a rod micelle thickener composition, lower alkyl glycol ether solvent and hardness sequestering agent. The application also describes a method of cleaning a food preparation unit having at least one substantially vertical surface having a baked food soil coating. In practice, however, none of the art has been found to be very effective in removing baked-on, polymerized soil from metal and other substrates.

The use of solvents in the automatic dishwashing context is also known. JP-A-10,017,900 discloses an automatic dishwashing auxiliary composition comprising non-ionic low foaming surfactant, organic solvent and water. The composition delivers detergency and drying benefits. JP-A-11,117,000 discloses a cleaning assistant composition for automatic dishwashing machines comprising surfactant, organic high-molecular polyelectrolyte, water-soluble solvent and water. The claimed assistant composition helps in the cleaning of stubborn dirt such as that due to oil or lipstick.

There is still the need for a method and products having improved efficacy for the removal of cooked-, baked- and burnt-on soils from cookware and tableware using an automatic dishwashing machine and avoiding the use of a pre-treatment step.

SUMMARY OF THE INVENTION

According to a first aspect of the present invention, there is provided a method of removing cooked-, baked-, or burnt-on food soil (such as grease, meat, dairy, fruit, pasta and any other food especially difficult to remove after the cooking process) from cookware and tableware (including stainless steel, glass, plastic, wood and ceramic objects). The method comprises washing the cookware/tableware in an automatic dishwashing machine in presence of a plurality of compositions, including at least one organic solvent composition. The purpose of using a plurality of compositions is to have different compositions for the cleaning of the different soils and substrates present in a dishwashing machine load. The plurality of compositions are formulated not only for the basic cleaning purpose but also for providing the dishwashing load with good aesthetic features such as shine, filming, spotting, etc. Organic solvent compositions (comprising a single solvent compound or a mixture of solvent compounds) for use herein preferably have a volatile organic content above 1 mm Hg of less than about 50%, preferably less than about 20% and more preferably less than about 10% by weight of the solvent system. Herein volatile organic content of the solvent system is defined as the content of organic components in the solvent system having a vapor pressure higher than the prescribed limit at 25° C. and atmospheric pressure.

In preferred embodiments the plurality of compositions includes at least one organic solvent composition and at least one automatic dishwashing detergent composition or the plurality of compositions includes two or more solvent compositions. The optimum concentration of solvent in the wash liquor is from about 100 ppm to about 10000 ppm, preferably from about 200 to about 8000 and more preferably from about 500 to about 5000 ppm. Preferably, the wash liquor has a liquid surface tension of less than about 35 mN/m, preferably less than about 32 mN/m more preferably less than about 30 mN/m and especially less than about 28 mN/m. The pH of the wash liquor will generally be in the alkaline range, preferably at least 10.5 or more preferably at least 11.0, this pH being provided by means of an alkalinity source or sources in one or more compositions used for delivery of the solvent, surfactant and builder.

The compositions of the invention can be delivered into the same or different cycles of the automatic dishwashing machine. The soiled cookware/tableware is washed in the resulting solvent-containing wash liquor.

Thus, according to another embodiment the removal of cooked-, baked-, or burnt-on food soil from cookware and tableware can be carried out by the use of a plurality of compositions, including one or more organic solvent compositions (wherein "solvent composition" is understood to comprise the organic solvent system and optional additional active ingredients and diluents) and one or more automatic dishwashing detergent compositions. The organic solvent composition can be built, unbuilt or generally unbuilt, but when used as an additive composition in conjunction with a dishwashing detergent composition, the solvent composition will normally be relatively unbuilt by comparison with the detergent composition. By "relatively unbuilt" is meant that under normal use conditions, the solvent composition will deliver a minor proportion (less than 50%, preferably less than 25%, more preferably less than 10% by weight) of the total builder delivered to the wash liquor by the one or more solvent compositions and the one or more detergent compositions. By "generally unbuilt" is meant that the composition contains less than about 5% by weight of detergency builder.

According to different embodiments of the present invention, the solvent compositions and automatic dishwashing detergent compositions can be delivered either at the same or at different points of the dishwashing cycle, for example: i) solvent composition and automatic dishwashing detergent composition are independently delivered in the pre-wash cycle and in the main-wash cycle, respectively; ii) a solvent composition and a first automatic dishwashing detergent composition are delivered in the pre-wash cycle and a second automatic dishwashing detergent composition in the main-wash cycle; iii) a first solvent composition and a first automatic dishwashing detergent composition are delivered in the pre-wash cycle and a second solvent composition and a second automatic dishwashing detergent composition in the main-wash cycle; iv) a solvent composition and an automatic dishwashing detergent composition are delivered simultaneously in the main-wash cycle; and v) a solvent composition and an automatic dishwashing detergent composition are delivered in the pre-wash and in the main-wash cycle.

Another embodiment provides a method of removing cooked-, baked-, or burnt-on food soil from cookware and tableware comprising washing the cookware/tableware in the pre-wash cycle of an automatic dishwashing machine in the presence of an organic solvent composition and thereafter rinsing the cookware/tableware in the rinse cycle of the automatic dishwashing machine in the presence of an automatic dishwashing rinse composition.

In preferred embodiments, the organic solvent composition and the automatic dishwashing detergent composition are delivered either i) from separate storage means (e.g. different bottles in the case of liquid compositions, different pouches, etc.) into the same cycle of an automatic dishwashing machine. Preferably, the organic solvent composition provides a wash liquor concentration of organic solvent as prescribed herein and preferably in the range from about 100 to about 10000 ppm, preferably from about 500 to about 5000; or ii) from separate zones of a multi-zone storage means (e.g. multi-compartment bottle in the case of liquid compositions) into the same or different cycles of an automatic dishwashing machine. Suitably, the organic solvent composition and the automatic dishwashing detergent composition are delivered from separate zones of a multi-zone storage means at a feed ratio (solvent composition: detergent composition) in the range from about 5:1 to about 1:50, preferably from about 2:1 to about 1:6 and more preferably from about 1:1 to about 1:5 to provide a wash liquor concentration of organic solvent in the range preferably from about 100 to about 10000, more preferably from about 500 to about 5000 ppm. Alternatively, the organic solvent composition and the automatic dishwashing detergent composition are delivered from separate zones of a multi-zone storage means sequentially into the pre-wash and main wash cycle, respectively. This can be valuable in the case of product incompatibility to reduce interaction between the organic solvent composition and the automatic dishwashing detergent composition. Where, the organic solvent composition and the automatic dishwashing detergent composition are delivered simultaneously from separate zones of a multi-zone storage means, the physical form of the organic solvent composition and/or automatic dishwashing detergent composition is preferably such as to prevent intimate mixing of the compositions prior to contact thereof with the wash liquor.

The invention can be also reduced to practice using multi-phase, "all-in-one" products. Thus, according to another embodiment of the invention, there is provided a method of removing cooked-, baked-, or burnt-on food soil from cookware and tableware comprising delivering separate portions of a multi-phase detergent composition into the same or different cycles of an automatic dishwashing machine, wherein the multi-phase detergent composition comprises at least a first phase containing an organic solvent composition and at least a second phase containing an automatic dishwashing detergent composition. The multiphase detergent composition, for example could take the form of a multi-layer liquid (e.g. coacervate) or gel contained in a bottle, or a multiphase tablet incorporating the solvent composition in the form of a gel contained within a preformed cavity or recess within the main tablet body. In either instance, the level of solvent delivered to the wash process should be such as to deliver the benefits on cooked-, baked- or burnt-on food soils.

The present invention also envisages the use of multiple organic solvent compositions. Thus according to another embodiment, there is provided a method of removing cooked-, baked-, or burnt-on food soil from cookware and tableware comprising delivering a plurality of organic solvent compositions of different solvent characteristics into the same or different cycles of an automatic dishwashing machine, for example, a first solvent composition in the pre-wash cycle and a second solvent composition in the main-wash cycle. For optimum performance, the different organic solvent compositions are designed to be specific to different soil and/or substrates. They can be delivered into different cycles of a dishwashing machine, with or without different automatic dishwashing detergent compositions, such that, for example, a first solvent composition and a first automatic dishwashing detergent composition are delivered into the pre-wash cycle and a second solvent composition and a second automatic dishwashing detergent composition are delivered into the main-wash cycle.

In another embodiment of the invention the organic solvent composition can be in a unit dose form allowing controlled release (for example delayed, sustained, triggered or slow release) of the composition during one or more repeated washing cycles. Especially suitable are unit dose form allowing delayed release of organic solvent until after the pre-wash cycle. In preferred unit dose forms, the solvent composition is contained in a single or multi-compartment pouch.

In the methods of the invention the organic solvent composition can be in the form of a liquid, paste, cream or gel and can be optionally encapsulated, packaged in a single- or multi-compartment pouch, or absorbed onto a porous carrier material. The solvent composition can be aqueous but preferably is anhydrous. Preferred pouches for use herein are water-soluble, solvent-resistant partially hydrolysed PVA pouches.

Preferably organic solvent compositions for use herein comprise an organoamine solvent or other agent effective in removing the soil and have a liquid surface tension of less than about 24.5 mN/m, preferably less than about 24 mN/m, more preferably less than about 23.5 mN/m.

In preferred embodiments the organic solvent composition additionally comprises a spreading auxiliary. The function of the spreading auxiliary is to reduce the interfacial tension between the organic solvent and the soil, therefore increasing the wettability of soils by the organic solvents. The spreading auxiliary when added to the compositions herein containing organic solvents effective in removing the soil leads to a lowering in the surface tension of the compositions, preferred spreading auxiliaries being those which lower the surface tension below that of the auxiliary itself. Especially useful are spreading auxiliaries able to render a surface tension below about 30 mN/m, preferably below about 28 mN/m and more preferably below about 26 mN/m, and especially below about 24 mN/m. Surface tensions are measured herein at 25° C. Spreading auxiliaries for use herein can be selected from organic solvents, wetting agents and mixtures thereof.

The invention can also be applied to single-phase "all-in-one" products. According to this aspect, a method of removing cooked-, baked-, or burnt-on food soil from cookware and tableware comprises washing the cookware/tableware in an automatic dishwashing machine with an automatic dishwashing detergent composition comprising surfactant (preferably comprising low-foaming nonionic surfactant), detergency builder and organic solvent system in levels sufficient to provide a wash liquor concentration of from about 10 ppm to about 1000 ppm surfactant, from about 100 ppm to about 5000 ppm detergency builder, and about 100 ppm to about 10,000, preferably from about 500 ppm to about 5000 ppm of organic solvent.

The optimum organic solvent systems for use herein are characterised by extremely low liquid surface tensions and contact angles on polymerised grease-coated substrates. Moreover, they generally consist of mixed solvent systems displaying synergistic contact angle and low surface tension. The organic solvent system herein preferably has a liquid surface tension at 25° C. of less than about 27 mN/m, preferably less than 25 mN/m. Suitable for the present invention are organic solvent systems comprising a plurality of solvent components in levels such that the solvent system has a surface tension less than, and preferably at least 1 mN/m less than that of any of the individual solvent components. In terms of contact angle, compositions containing the solvent system preferably display an advancing contact angle on a polymerised grease-coated substrate at 25° C. of less than 20°, preferably less than 10° and more preferably less than 5°. Furthermore, the advancing contact angle for compositions based on mixed solvent systems should be less than that of any of the corresponding compositions containing the individual components of the solvent system. Such solvent systems and compositions are found to be optimum for the removal of burnt-on soils having a high carbon content from cookware and tableware.

The method for determining contact angle is as follows. A sample plate (prepared as described below) is dipped into and pulled out of a liquid and contact angles calculated after Wilhelmy Method. The force exerted on the sample according to the immersion depth is measured (using a Kruss K12 tensiometer and System K121 software) and is proportional to the contact angle of the liquid on the solid surface. The sample plate is prepared as follows: Spray 30–50 grams of Canola Oil into a beaker. Dip a glass slide (3×9×0.1 cm) into the Oil and thoroughly coat the surface. This results in an evenly dispersed layer of oil on the surface. Adjust the weight of product on the slide's surface until approximately 0.5 g of oil has been delivered and evenly distributed. At this point, bake the slides at 450 F. for 20 minutes, and allow to cool to room temperature.

A broad range of organic solvents are suitable for use herein but preferably the organic solvent is selected from alcohols, amines, esters, glycol ethers, glycols, terpenes and mixtures thereof. The organic solvent system is preferably formulated to meet the constraints on volatile solvent components described above and in highly preferred embodiments the solvent system will contain less than about 50%, preferably less than 20% and more preferably less than 10% of solvent components having a vapor pressure above about 0.1 mm Hg at 25° C. and atmospheric pressure. In highly preferred embodiments, the solvent is essentially free (contains less than about 5% by weight) of solvent components having a boiling point below about 150° C., flash point below about 100° C. or a vapor pressure above about 1 mm Hg at 25° C. and atmospheric pressure.

The organic solvent system for use herein is preferably selected from organoamine solvents, inclusive of alkanolamines, alkylamines, alkyleneamines and mixtures thereof; alcoholic solvents inclusive of aromatic, aliphatic (preferably $C_4$–$C_{10}$) and cycloaliphatic alcohols and mixtures thereof; glycols and glycol derivatives inclusive of $C_2$–$C_3$ (poly)alkylene glycols, glycol ethers, glycol esters and mixtures thereof; and mixtures selected from organoamine solvents, alcoholic solvents, glycols and glycol derivatives. In one preferred embodiment the organic solvent comprises organoamine (especially alkanolamine, more especially 2-aminalkanol) solvent and glycol ether solvent, preferably in a weight ratio of from about 3:1 to about 1:3, and wherein the glycol ether solvent is selected from ethylene glycol monobutyl ether, diethylene glycol monobutyl ether, ethylene glycol monomethyl ether, ethylene glycol monoethyl ether, diethylene glycol monomethyl ether, diethylene glycol monoethyl ether, propylene glycol monobutyl ether, and mixtures thereof. Preferably, the glycol ether is a mixture of diethylene glycol monobutyl ether and propylene glycol butyl ether, especially in a weight ratio of from about 1:2 to about 2:1.

In other preferred embodiments, suitable organic solvents include one or more water-soluble or dispersible, preferably hydroxylated organoamine solvents, especially alkanolamine solvents having a pKa of at least 8.8, preferably at least 9.3 and more preferably at least 9.8. In these embodiments, the organic solvent system preferably comprises a mixture of a first organoamine solvent having a pKa of about 9.5 or less and a second organoamine solvent having a pKa greater than about 9.5. Also preferred for use herein are organic solvents comprising salts of organoamines which are introduced into the wash liquor of the automatic dishwashing machine at a wash liquor pH above the highest pKa of the organoamine and which thereby act as a source of organoamine solvent. Suitable salt counterions include halides such as chloride and bromide, oxyanions such as sulphate, borate, phosphate, pyrophosphate and polyphosphate and surfactant anions.

In a preferred embodiment the organic solvent comprises one or more organoamines which is/are introduced into the wash liquor of an automatic dishwashing machine in the form of their ammonium salt at a wash liquor pH above the highest pKa of the organoamine/s.

The effect of the solvent system can be further improved by the addition of certain wetting agents. Preferably, the organic solvent system is used in conjunction with a wetting agent effective in lowering the surface tension of the solvent system, preferably to at least 1 mN/m less than that of the wetting agent, the wetting agent preferably being selected from organic surfactants having a surface tension less than about 30 mN/m, more preferably less than about 28 mN/m and specially less than about 26 mN/m. Preferred wetting agents for use herein are silicone polyether copolymers, especially silicone poly(alkyleneoxide)copolymers wherein alkylene is selected from ethylene, propylene and mixtures thereof.

In terms of solvent parameters, the organic solvent can be selected from:

a) polar, hydrogen-bonding solvents having a Hansen solubility parameter of at least 20 $(Mpa)^{1/2}$, a polarity parameter of at least 7 $(Mpa)^{1/2}$, preferably at least 12 $(Mpa)^{1/2}$ and a hydrogen bonding parameter of at least 10 $(Mpa)^{1/2}$ b) polar non-hydrogen bonding solvents having a Hansen solubility parameter of at least 20 $(Mpa)^{1/2}$, a polarity parameter of at least 7 $(Mpa)^{1/2}$, preferably at least 12 $(Mpa)^{1/2}$ and a hydrogen bonding parameter of less than 10 $(Mpa)^{1/2}$, c) amphiphilic solvents having a Hansen solubility parameter below 20 $(Mpa)^{1/2}$, a polarity parameter of at least 7 $(Mpa)^{1/2}$ and a hydrogen bonding parameter of at least 10 $(Mpa)^{1/2}$, d) non-polar solvents having a polarity parameter below 7 $(Mpa)^{1/2}$ and a hydrogen bonding parameter below 10 $(Mpa)^{1/2}$ and e) mixtures thereof.

The invention also relates to detergent packs and multi-component products suitable for use in an automatic dishwashing machine or dishwashing pretreatment to provide baked and burnt-on soil removal and other cleaning benefits. In one embodiment, there is provided an automatic dishwashing detergent pack comprising two or more automatic dishwashing detergent and/or auxiliary products, storage means comprising separate but associated portions of the two or more products and means, for example electric pump means, for delivering quantities of the two or more products into the same or different cycles of an automatic dishwashing machine. The pack can also comprise means for controlling the relative dispensing rate of the two or more products from the storage means. The pack preferably comprises an organic solvent composition and an automatic dishwashing detergent composition and is used for removing cooked-, baked-, and burnt-on food soil from cookware and tableware. In a preferred embodiment the two or more automatic dishwashing detergent or auxiliary products are in rheology-matched gel-form. Compositions are considered to be rheology-matched if they have similar yield values (differing by less than about 50%, preferably by less than about 20%) and/or similar viscosities (differing by less than about 50%, preferably by less than about 20%) under the same shear conditions.

The invention also relates to organic solvent compositions suitable for use in automatic dishwashing. In one embodiment, an organic solvent composition comprises about 1% to about 99%, preferably from about 5% to about 90% of an organic solvent system for removing cooked-, baked-, or burnt-on food soil from cookware and tableware, from about 0.5% to about 50%, preferably from about 5% to about 25% of bleach and from about 0.0001% to about 10% of detergency enzyme. The compositions preferably are in gel-form and contain a thickener such as methylcellulose or other nonionic cellulosic thickener. The solvent compositions are preferably anhydrous (containing less than about 5%, preferably less than about 1% of water) and comprise bleach in the form of a particulate suspension having an average particle size in the range from about 10 to about 100$\mu$m, preferably from about 25 to about 75 $\mu$m. The compositions are also builder free or generally builder free. It is a feature of the invention that a broad range of solvents, including organoamine solvents can be incorporated in the solvent compositions of the invention with acceptable bleach stability provided the water content of the composition is carefully controlled.

The invention also relates to detergent compositions suitable for use in automatic dishwashing or dishwashing pretreatment. In one embodiment, an automatic dishwashing detergent composition comprises from about 0.05% to about 10% by weight of a low-foaming non-ionic surfactant, from about 1% to about 30% of an organoamine, preferably alkanolamine (especially monoethanolamine) solvent and at least about 5% by weight of a detergency builder. Preferably, the automatic dishwashing detergent composition is in the form of a gel comprising from about 2% to about 20%, preferably from 5% to 15% by weight of an alkanolamine, at least about 5% by weight of detergency builder, and from about 0.1% to about 5% by weight of a low foaming non-ionic surfactant. Although any non-ionic low foaming surfactant (or combination of non-ionic surfactants and suds suppressers) can be used herein, capped nonionic surfactants and combinations or amine oxide and capped non-ionic surfactants are preferred. The compositions also preferably have a pH (1% aqueous solution) in excess of about 9.0, preferably in excess of about 10.5 and more preferably greater than about 11.

In one embodiment, an automatic dishwashing detergent composition comprises from about 0.05% to about 10% by weight of a low-foaming non-ionic surfactant, from about 1% to about 30% of an organic solvent, preferably alkanolamine solvent, at least about 5% by weight of a detergency builder and a wetting agent, preferably a silicone-poly (alkyleneoxide)copolymers.

In a preferred embodiment an automatic dishwashing detergent pack is provided, comprising: i) an organic solvent composition suitable for use in automatic dishwashing comprising from about 1% to about 99%, preferably from about 5% to about 90%, especially from about 40% to about 80% of an organic solvent system for removing cooked-, baked-, or burnt-on food soil from cookware and tableware, from about 0.5% to about 50%, preferably from about 5% to about 25% of bleach, from about 0.0001% to about 10% of detergency enzyme, and wherein the composition is in the form of an anhydrous gel comprising bleach in the form of a particulate suspension; and ii) an automatic dishwashing detergent composition comprising from about 0.05% to about 10% by weight of a low-foaming non-ionic surfactant, optionally from about 1% to about 30% of an organoamine, preferably alkanolamine solvent, and at least about 5% by weight of a detergency builder. Preferably, the automatic dishwashing detergent composition is in the form of a gel comprising from about 2% to about 20%, preferably from about 5% to about 15% by weight of the composition of an alkanolamine, at least about 5% by weight of detergency builder (such as sodium potassium tripolyphosphate), and from about 0.1% to about 5% by weight of the composition of a low foaming non-ionic surfactant.

The compositions of the invention are also characterised by having a low volatile organic content, preferably with a volatile organic content less than about 20%, preferably less than about 10% and more preferably less than about 5%.

Suitable thickening agents for use in the solvent compositions and dishwashing detergent compositions herein include viscoelastic, thixotropic thickening agents at levels of from about 0.1% to about 10%, preferably from about 0.25% to about 5%, most preferably from about 0.5% to about 3% by weight. Suitable thickening agents include polymers with a molecular weight from about 500,000 to about 10,000,000, more preferably from about 750,000 to about 4,000,000. The preferred cross-linked polycarboxylate polymer is preferably a carboxyvinyl polymer. Such compounds are disclosed in U.S. Pat. No. 2,798,053, issued on Jul. 2, 1957, to Brown. Methods for making carboxyvinyl polymers are also disclosed in Brown. Carboxyvinyl polymers are substantially insoluble in liquid, volatile organic hydrocarbons and are dimensionally stable on exposure to air.

Preferred polyhydric alcohols used to produce carboxyvinyl polymers include polyols selected from the class consisting of oligosaccarides, reduced derivatives thereof in which the carbonyl group is converted to an alcohol group, an pentaerythritol; most preferred is sucrose or pentaerythritol. It is preferred that the hydroxyl groups of the modified polyol be etherified with alkyl groups, the polyol having at least two allyl ether groups per polyol molecule. When the polyol is sucrose, it is preferred that the sucrose have at least about five allyl ether groups per sucrose molecule. It is preferred that the polyether of the polyol comprise from about 0.1% to about 4% of the total monomers, more preferably from about 0.2% to about 2.5%.

Preferred monomeric olefinically unsaturated carboxylic acids for use in producing carboxyvinyl polymers used herein include monomeric, polymerizable, alpha-beta monoolefinically unsaturated lower aliphatic carboxylic acids; more preferred are monomeric monoolefinic acrylic acids of the structure:

$$CHCH2{=}C(R){-}COOH$$

where R is a substituent selected from the group consisting of hydrogen and lower alkyl groups; most preferred is acrylic acid.

Various carboxyvinyl polymers, homopolymers and copolymers are commercially available from B. F. Goodrich Company, New York, N.Y., under the trade name Carbopol®. These polymers are also known as carbomers or polyacrylic acids. Carboxyvinyl polymers useful in formulations of the present invention include Carbopol 910 having a molecular weight of about 750,000, Carbopol 941 having a molecular weight of about 1,250,000, and Carbopols 934 and 940 having molecular weights of about 3,000,000 and 4,000,000, respectively. More preferred are the series of Carbopols which use ethyl acetate and cyclohexane in the manufacturing process, Carbopol 981, 2984, 980, and 1382.

Preferred polycarboxylate polymers are non-linear, water-dispersible, polyacrylic acid cross-linked with a polyalkenyl polyether and having a molecular weight of from about 750,000 to about 4,000,000.

Highly preferred examples of these polycarboxylate polymers for use in the present invention are Sokalan PHC-25®, a polyacrylic acid available from BASF Corporation, the Carbopol 600 series resins available from B. F. Goodrich, and more preferred is Polygel DK available from 3-V Chemical Corporation. Mixtures of polycarboxylate polymers as herein described may also be used in the present invention.

Other suitable thickening agents include inorganic clays (e.g. laponites, aluminium silicate, bentonite, fumed silica). The preferred clay thickening agent can be either naturally occurring or synthetic. Preferred synthetic clays include the synthetic smectite-type clay sold under the trademark Laponite by Southern Clay Products, Inc. Particularly useful are gel forming grades such as Laponite RD and sol forming grades such as Laponite RDS. Natural occurring clays include some smectite and attapulgite clays. Mixtures of clays and polymeric thickeners are also suitable for use herein.

Other types of thickeners which can be used in this composition include natural gums, such as xanthan gum, locust bean gum, guar gum, and the like. The cellulosic type thickeners: hydroxyethyl and hydroxymethyl cellulose (ETHOCEL and METHOCEL® available from Dow Chemical) can also be used.

It is a feature of the invention that many of the solvent systems and compositions of the invention that are optimum for cleaning also demonstrate improved compatibility with partially hydrolysed PVA pouch materials of known construction and type. This is particularly surprising given that many well-known polar/or hydrolysed bonding solvent materials (for example the ethanolamines) in themselves have low compatibility with PVA materials and present serious issues for product stability. Solvent systems comprising mixtures of polar hydrogen bonding solvents (such as the organoamines) with a cosolvent selected from polar non-hydrogen bonding, amphiphilic and non-polar solvents and mixtures thereof are particularly valuable in this respect. Also valuable for improved PVA compatibility are organoamines present in composition in the form of amine salt. Also valuable for improved PVA compatibility are solvent systems and components based on propanolamines such as 2-amino-2-methyl propanol. Compositions suitable for inclusion in pouches will normally comprise a major proportion of solvent system components, preferably at least 50% by weight, more preferably at least 70% by weight or even higher.

DETAILED DESCRIPTION OF THE INVENTION

The present invention envisages the use of plurality of compositions including at least one organic solvent composition into the same or different cycles of an automatic dishwashing machine and washing the soiled cookware/tableware in the resulting solvent-containing wash liquor. It also envisages multi-component dishwashing products containing purpose-designated combination of solvent compositions and dishwashing detergent compositions. The invention also envisages so called "all-in-one" detergent products having both an alkaline detergent and a solvent functionality. In the case of additive and multi-component products, the invention does not require the two compositions to be in the same physical form. The organic solvent composition can be in any physical form, e.g. liquid, paste, cream, gel, powder, granules or tablets and similarly the automatic dishwashing detergent composition can be in any of these forms. Preferably, however, both compositions are in the form of liquids or gels or the organic solvent composition is in the form of liquid or gel and the automatic dishwashing detergent composition is in the form of powder, granules or tablet. The compositions used herein can be dispensed from any suitable device, such as bottles (pump assisted bottles, squeeze bottles), paste dispensers, capsules, multi-compartment bottles, multi-compartment capsules, pouches, and multi-compartment pouches, etc.

The solvent compositions herein comprise one or more organic solvents and can additionally comprises surfactant, bleach, enzyme, enzyme stabilising components, thickener, etc.

The organic solvents should be selected so as to be compatible with the tableware/cookware as well as with the different parts of an automatic dishwashing machine. Furthermore, the solvent system should be effective and safe to use having a volatile organic content above 1 mm Hg (and preferably above 0.1 mm Hg) of less than about 50%, preferably less than about 30%, more preferably less than about 10% by weight of the solvent system. Also they should have very mild pleasant odours. The individual organic solvents used herein generally have a boiling point above about 150° C., flash point above about 100° C. and vapor pressure below about 1 mm Hg, preferably below 0.1 mm Hg at 25° C. and atmospheric pressure.

Solvents that can be used herein include: i) alcohols, such as benzyl alcohol, 1,4-cyclohexanedimethanol, 2-ethyl-1-hexanol, furfuryl alcohol, 1,2-hexanediol and other similar materials; ii) amines, such as alkanolamines (e.g. primary alkanolamines: monoethanolamine, monoisopropanolamine, diethylethanolamine, ethyl diethanolamine, beta-aminoalkanols; secondary alkanolamines: diethanolamine, diisopropanolamine, 2-(methylamino) ethanol; ternary alkanolamines: triethanolamine, triisopropanolamine); alkylamines (e.g. primary alkylamines: monomethylamine, monoethylamine, monopropylamine, monobutylamine, monopentylamine, cyclohexylamine), secondary alkylamines: (dimethylamine), alkylene amines (primary alkylene amines: ethylenediamine, propylenediamine) and other similar materials; iii) esters, such as ethyl lactate, methyl ester, ethyl acetoacetate, ethylene glycol monobutyl ether acetate, diethylene glycol monoethyl ether acetate, diethylene glycol monobutyl ether acetate and other similar materials; iv) glycol ethers, such as ethylene glycol monobutyl ether, diethylene glycol monobutyl ether, ethylene glycol monomethyl ether, ethylene glycol monoethyl ether, diethylene glycol monomethyl ether, diethylene glycol monoethyl ether, propylene glycol butyl ether and other similar materials; v) glycols, such as propylene glycol, diethylene glycol, hexylene glycol(2-methyl-2, 4 pentanediol), triethylene glycol, composition and dipropylene glycol and other similar materials; and mixtures thereof.

Preferred solvents effective in removing cooked-, baked- or burnt-on food soil to be used herein comprise alkanolamines, especially monoethanolamine, beta-aminoalkanols, especially 2-amino-2-methyl-propanol (since it has the lowest molecular weight of any beta-aminoalkanol which has the amine group attached to a tertiary carbon, therefore minimize the reactivity of the amine group) and mixtures thereof.

The detergent and cleaning compositions herein can comprise traditional detergency components and can also comprise organic solvents having a cleaning function and organic solvents having a carrier or diluent function or some other specialised function. The compositions will generally be built and comprise one or more detergent active components which may be selected from colorants, bleaching agents, surfactants, alkalinity sources, enzymes, thickeners (in the case of liquid, paste, cream or gel compositions), anti-corrosion agents (e.g. sodium silicate), hydrotropes (e.g. sodium cumene sulfate) and disrupting and binding agents (in the case of powder, granules or tablets). Highly preferred detergent components include a builder compound, an alkalinity source, a surfactant, an enzyme and a bleaching agent.

Unless otherwise specified, the components described hereinbelow can be incorporated either in the organic solvent compositions and/or the detergent or cleaning compositions.

Surfactant

In the methods of the present invention for use in automatic dishwashing the detergent surfactant is preferably low foaming by itself or in combination with other components (i.e. suds suppressers). In compositions and methods of the present invention for use in hard surface cleaning or pretreatment prior to dishwashing, the detergent surfactant is preferably foamable in direct application but low foaming in automatic dishwashing use. Surfactants suitable herein include anionic surfactants such as alkyl sulfates, alkyl ether sulfates, alkyl benzene sulfonates, alkyl glyceryl sulfonates, alkyl and alkenyl sulphonates, alkyl ethoxy carboxylates, N-acyl sarcosinates, N-acyl taurates and alkyl succinates and sulfosuccinates, wherein the alkyl, alkenyl or acyl moiety is $C_5$–$C_{20}$, preferably $C_{10}$–$C_{18}$ linear or branched; cationic surfactants such as chlorine esters (U.S. Pat. Nos. 4,228,042, 4,239,660 and 4,260,529) and mono $C_6$–$C_{16}$ N-alkyl or alkenyl ammonium surfactants wherein the remaining N positions are substituted by methyl, hydroxyethyl or hydroxypropyl groups; low and high cloud point nonionic surfactants and mixtures thereof including nonionic alkoxylated surfactants (especially ethoxylates derived from $C_6$–$C_{18}$ primary alcohols), ethoxylated-propoxylated alcohols (e.g., Olin Corporation's Poly-Tergent® SLF18), epoxy-capped poly(oxyalkylated) alcohols (e.g., Olin Corporation's Poly-Tergent® SLF18B—see WO-A-94/22800), ether-capped poly(oxyalkylated) alcohol surfactants, and block polyoxyethylene-polyoxypropylene polymeric compounds such as PLURONIC®, REVERSED PLURONIC®, and TETRONIC® by the BASF-Wyandotte Corp., Wyandotte, Mich.; amphoteric surfactants such as the $C_{12}$–$C_{20}$ alkyl amine oxides (preferred amine oxides for use herein include lauryldimethyl amine oxide and hexadecyl dimethyl amine oxide), and alkyl amphocarboxylic surfactants such as Miranol™ C2M; and zwitterionic surfactants such as the betaines and sultaines; and mixtures thereof. Surfactants suitable herein are disclosed, for example, in U.S. Pat. Nos. 3,929,678, 4,259,217, EP-A-0414 549, WO-A-93/08876 and WO-A-93/08874. Surfactants are typically present at a level of from about 0.2% to about 30% by weight, more preferably from about 0.5% to about 10% by weight, most preferably from about 1% to about 5% by weight of composition. Preferred surfactant for use herein are low foaming and include low cloud point nonionic surfactants and mixtures of higher foaming surfactants with low cloud point nonionic surfactants which act as suds suppresser therefor.

Builder

Builders suitable for use herein include water-soluble builders such as citrates, carbonates and polyphosphates e.g. sodium tripolyphosphate and sodium tripolyphosphate hexahydrate, potassium tripolyphosphate and mixed sodium and potassium tripolyphosphate salts; and partially water-soluble or insoluble builders such as crystalline layered silicates (EP-A-0164514 and EP-A-0293640) and aluminosilicates inclusive of Zeolites A, B, P, X, HS and MAP. The builder is typically present at a level of from about 1% to about 80% by weight, preferably from about 10% to about 70% by weight, most preferably from about 20% to about 60% by weight of composition.

Amorphous sodium silicates having an $SiO_2$:$Na_2O$ ratio of from 1.8 to 3.0, preferably from 1.8 to 2.4, most preferably 2.0 can also be used herein although highly preferred from the viewpoint of long term storage stability are compositions containing less than about 22%, preferably less than about 15% total (amorphous and crystalline) silicate.

Enzyme

Enzymes suitable herein include bacterial and fungal cellulases such as Carezyme and Celluzyme (Novo Nordisk A/S); peroxidases; lipases such as Amano-P (Amano Pharmaceutical Co.), M1 Lipase$^R$ and Lipomax$^R$ (Gist-Brocades) and Lipolase$^R$ and Lipolase Ultra$^R$ (Novo); cutinases; proteases such as Esperase$^R$, Alcalase$^R$, Durazym$^R$ and Savinase$^R$ (Novo) and Maxatase$^R$, Maxacal$^R$, Properase$^R$ and Maxapem$^R$ (Gist-Brocades); and α and β amylases such as Purafect Ox Am$^R$ (Genencor) and Termamyl$^R$, Ban$^R$, Fungamyl$^R$, Duramyl$^R$, and Natalase$^R$ (Novo); and mixtures thereof. Enzymes are preferably added herein as prills, granulates, or cogranulates at levels typically in the range from about 0.0001% to about 2% pure enzyme by weight of composition.

Bleaching Agent

Bleaching agents suitable herein include chlorine and oxygen bleaches, especially inorganic perhydrate salts such as sodium perborate mono-and tetrahydrates and sodium percarbonate optionally coated to provide controlled rate of release (see, for example, GB-A-1466799 on sulfate/carbonate coatings), preformed organic peroxyacids and mixtures thereof with organic peroxyacid bleach precursors and/or transition metal-containing bleach catalysts (especially manganese or cobalt). Inorganic perhydrate salts are typically incorporated at levels in the range from about 1% to about 40% by weight, preferably from about 2% to about 30% by weight and more preferably from abut 5% to about 25% by weight of composition. Peroxyacid bleach precursors preferred for use herein include precursors of perbenzoic acid and substituted perbenzoic acid; cationic peroxyacid precursors; peracetic acid precursors such as TAED, sodium acetoxybenzene sulfonate and pentaacetylglucose; pemonanoic acid precursors such as sodium 3,5,5-trimethylhexanoyloxybenzene sulfonate (iso-NOBS) and sodium nonan sulfonate (NOBS); amide substituted alkyl peroxyacid precursors (EP-A-0170386); and benzoxazin peroxyacid precursors (EP-A-0332294 and EP-A-0482807). Bleach precursors are typically incorporated at levels in the range from about 0.5% to about 25%, preferably from about 1% to about 10% by weight of composition while the preformed organic peroxyacids themselves are typically incorporated at levels in the range from 0.5% to 25% by weight, more preferably from 1% to 10% by weight of composition. Bleach catalysts preferred for use herein include the manganese triazacyclononane and related complexes (U.S. Pat. Nos. 4,246,612, 5,227,084); Co, Cu, Mn and Fe bispyridylamine and related complexes (U.S. Pat. No. 5,114,611); and pentamine acetate cobalt(III) and related complexes(U.S. Pat No. 4,810,410).

Low Cloud Point Non-Ionic Surfactants and Suds Suppressers

The suds suppressers suitable for use herein include nonionic surfactants having a low cloud point. "Cloud point", as used herein, is a well known property of nonionic surfactants which is the result of the surfactant becoming less soluble with increasing temperature, the temperature at which the appearance of a second phase is observable is referred to as the "cloud point" (See Kirk Othmer, pp. 360–362). As used herein, a "low cloud point" nonionic surfactant is defined as a nonionic surfactant system ingredient having a cloud point of less than 30° C., preferably less than about 20° C., and even more preferably less than about 10° C., and most preferably less than about 7.5° C. Typical low cloud point nonionic surfactants include nonionic alkoxylated surfactants, especially ethoxylates derived from primary alcohol, and polyoxypropylene/polyoxyethylene/polyoxypropylene (PO/EO/PO) reverse block polymers. Also, such low cloud point nonionic surfactants include, for example, ethoxylated-propoxylated alcohol (e.g., Olin Corporation's Poly-Tergent® SLF18) and epoxy-capped poly(oxyalkylated) alcohols (e.g., Olin Corporation's Poly-Tergent® SLF18B series of nonionics, as described, for example, in U.S. Pat. No. 5,576,281).

Preferred low cloud point surfactants are the ether-capped poly(oxyalkylated) suds suppresser having the formula:

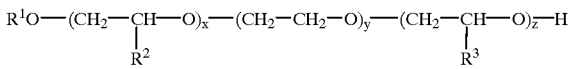

wherein $R^1$ is a linear, alkyl hydrocarbon having an average of from about 7 to about 12 carbon atoms, $R^2$ is a linear, alkyl hydrocarbon of about 1 to about 4 carbon atoms, $R^3$ is a linear, alkyl hydrocarbon of about 1 to about 4 carbon atoms, x is an integer of about 1 to about 6, y is an integer of about 4 to about 15, and z is an integer of about 4 to about 25.

Other low cloud point nonionic surfactants are the ether-capped poly(oxyalkylated) having the formula:

$$R_I O(R_{II}O)_n CH(CH_3)OR_{III}$$

wherein, $R_I$ is selected from the group consisting of linear or branched, saturated or unsaturated, substituted or unsubstituted, aliphatic or aromatic hydrocarbon radicals having from about 7 to about 12 carbon atoms; $R_{II}$ may be the same or different, and is independently selected from the group consisting of branched or linear $C_2$ to $C_7$ alkylene in any given molecule; n is a number from 1 to about 30; and $R_{III}$ is selected from the group consisting of:

(i) a 4 to 8 membered substituted, or unsubstituted heterocyclic ring containing from 1 to 3 hetero atoms; and (ii) linear or branched, saturated or unsaturated, substituted or unsubstituted, cyclic or acyclic, aliphatic or aromatic hydrocarbon radicals having from about 1 to about 30 carbon atoms;

(b) provided that when $R^2$ is (ii) then either: (A) at least one of $R^1$ is other than $C_2$ to $C_3$ alkylene; or (B) $R^2$ has from 6 to 30 carbon atoms, and with the further proviso that when $R^2$ has from 8 to 18 carbon atoms, R is other than $C_1$ to $C_5$ alkyl.

Other suitable components herein include organic polymers having dispersant, anti-redeposition, soil release or other detergency properties inventions in levels of from about 0.1% to about 30%, preferably from about 0.5% to about 15%, most preferably from about 1% to about 10% by weight of composition. Preferred anti-redeposition polymers herein include acrylic acid containing polymers such as Sokalan PA30, PA20, PA15, PA10 and Sokalan CP10 (BASF GmbH), Acusol 45N, 480N, 460N (Rohm and Haas), acrylic acid/maleic acid copolymers such as Sokalan CP5 and acrylic/methacrylic copolymers. Preferred soil release polymers herein include alkyl and hydroxyalkyl celluloses (U.S. Pat. No. 4,000,093), polyoxyethylenes, polyoxypropylenes and copolymers thereof, and nonionic and anionic polymers based on terephthalate esters of ethylene glycol, propylene glycol and mixtures thereof.

Heavy metal sequestrants and crystal growth inhibitors are suitable for use herein in levels generally from about 0.005% to about 20%, preferably from about 0.1% to about 10%, more preferably from about 0.25% to about 7.5% and most preferably from about 0.5% to about 5% by weight of composition, for example diethylenetriamine penta (methylene phosphonate), ethylenediamine tetra(methylene phosphonate)hexamethylenediamine tetra(methylene phosphonate), ethylene diphosphonate, hydroxy-ethylene-1, 1-diphosphonate, nitrilotriacetate, ethylenediaminotetracetate, ethylenediamine-N,N'-disuccinate in their salt and free acid forms.

The compositions herein can contain a corrosion inhibitor such as organic silver coating agents in levels of from about 0.05% to about 10%, preferably from about 0.1% to about 5% by weight of composition (especially paraffins such as Winog 70 sold by Wintershall, Salzbergen, Germany), nitrogen-containing corrosion inhibitor compounds (for example benzotriazole and benzimadazole—see GB-A-1137741) and Mn(II) compounds, particularly Mn(II) salts of organic ligands in levels of from about 0.005% to about 5%, preferably from about 0.01% to about 1%, more preferably from about 0.02% to about 0.4% by weight of the composition.

Other suitable components herein include colorants, water-soluble bismuth compounds such as bismuth acetate and bismuth citrate at levels of from about 0.01% to about 5%, enzyme stabilizers such as calcium ion, boric acid, propylene glycol and chlorine bleach scavengers at levels of from about 0.01% to about 6%, lime soap dispersants (see WO-A-93/08877), suds suppressors (see WO-93/08876 and EP-A-0705324), polymeric dye transfer inhibiting agents, optical brighteners, perfumes, fillers and clay.

Liquid detergent compositions can contain water and other volatile solvents as carriers. Low quantities of low molecular weight primary or secondary alcohols such as methanol, ethanol, propanol and isopropanol can be used in the liquid detergent of the present invention. Other suitable carrier solvents used in low quantities includes glycerol, propylene glycol, ethylene glycol, 1,2-propanediol, sorbitol and mixtures thereof.

EXAMPLES

Abbreviations Used in Examples

In the examples, the abbreviated component identifications have the following meanings:

| | |
|---|---|
| Carbonate | Anhydrous sodium carbonate |
| STPP | Sodium tripolyphosphate |
| SKTP | Sodium potassium tripolyphosphate |
| Silicate 3.2 | Amorphous Sodium Silicate ($SiO_2$:$Na_2O$ ratio = 3:2) |
| Silicate | Amorphous Sodium Silicate ($SiO_2$:$Na_2O$ ratio = 2.0) |
| SKS-6 | Crystalline layered silicate of formula δ-$Na_2Si_2O_5$ |
| KOH | Potassium hydroxide |
| H2SO4 | Sulphuric acid |
| HEDP | Ethane 1-hydroxy-1,1-diphosphonic acid |
| PB1 | Sodium perborate monohydrate average particle size 770 μm |
| PB1-50 | Sodium perborate monohydrate average particle size 50 μm |
| Termamyl | α-amylase available from Novo Nordisk A/S |
| FN3 | protease available from Genencor |
| Savinase | protease available from Novo Nordisk A/S |
| LF404 | low foaming surfactant available from Olin Corporation |
| SLF18 | low foaming surfactant available from Olin Corporation |
| ACNI | alkyl capped non-ionic surfactant of formula $C_{9/11}$ $H_{19/23}$ $EO_8$-cyclohexyl acetal |
| $C_{16}$AO | hexadecyl dimethyl amine oxide |
| PA30 | Polyacrylate homo-polymer of molecular weight approximately 8,000 available from BASF |
| Proxel GXL | preservative(1,2-benzisothiazolin-3-one) available from Zeneca, Inc |
| Polygel premix | 5% active Polygel DKP in water available from 3V Inc. |
| CaCl2 | Calcium chlorine |
| CHDM | Cyclohexane dimethanol |
| BTA | Benzotriazole |
| Winog | Paraffin oil sold by Wintershall. |
| Vivapur | Microcrystalline cellulose of average particle size 0.18 mm |
| Triacetate | Sodium acetate trihydrate |
| Duramyl | α-amylase available from Novo Nordisk A/S |
| Citrate | Tripotassium citrate monohydrate |
| Citric Acid | Anhydrous Citric acid |
| Bicarbonate | Sodium hydrogen carbonate |
| PEG 400 | Polyethylene Glycol molecular weight approximately 400 available from Hoechst |
| PEG 4000 | Polyethylene Glycol molecular weight approximately 4000 available from Hoechst |
| PVPVI | Polyvinylpyrrolidone vinylimidazole copolymer molecular weight approximately 15,000 available from BASF |
| MEA | Monoethanolamine |
| MAE | 2-(methylamino)ethanol |
| SF1488 | Polydimethylsiloxane copolymer |
| Dowanol PNB | Propylene glycol butyl ether |
| Silwet L7600 | Siloxane surfactant available from Witco |

In the following examples all levels are quoted as parts by weight.

Examples 1 to 5

A combination of solvent compositions and automatic dishwashing detergents are used to wash a load of tableware and cookware having cooked-on, baked-on and burnt-on food soils. The load comprises different soils and different substrates: lasagne baked for 2 hours at 140° C. on Pyrex, lasagne cooked for 2 hours at 150° C. on stainless steel, potato and cheese cooked for 2 hours at 150° C. on stainless steel, egg yolk cooked for 2 hours at 150° C. on stainless steel and sausage cooked for 1 hour at 120° C. followed by 1 hour at 180° C. The load is washed in a 5 litre liquor capacity Bosch 6032 dishwashing machine, at 55° C. without prewash, using the compositions given in Examples 1 to 5. Examples 1 to 5 illustrate the use of a combination of a two-phase automatic dishwashing detergent tablet and an organic solvent composition added separately to the main-wash cycle of the dishwashing machine. The two-component compositions of examples 1 to 5 provided excellent removal of cooked-on, baked-on and burnt-on food soils.

| Example | 1 | 2 | 3 | 4 | 5 |
|---|---|---|---|---|---|
| Dishwashing detergent composition Phase 1 | | | | | |
| Carbonate | 3.5 | 3.4 | 5.030 | 3.375 | 5.063 |
| STPP | 10.1 | 10.1 | 9.49 | 9.85 | 8.73 |
| Silicate | 1.1 | 1.0 | 1.58 | 1.61 | 1.548 |
| SKS-6 | 1.5 | 1.4 | 2.16 | 1.425 | 2.138 |
| HEDP | 0.18 | 0.18 | 0.27 | 0.18 | 0.27 |
| PB1 | 2.45 | 2.45 | 3.53 | 2.4 | 3.6 |
| Termamyl | 0.11 | 0.11 | 0.16 | 0.11 | 0.165 |
| FN3 | | | 0.15 | | |
| Savinase | 0.12 | 0.12 | 0.17 | 0.12 | 0.18 |
| LF404 | 0.60 | 0.60 | 0.86 | | |
| SLF18 | | | | 0.60 | 0.90 |
| $C_{16}$ AO | | | | 0.16 | 0.24 |
| PA30 | | 0.1 | | 0.1 | 0.15 |
| CHDM | | | | 0.02 | 0.03 |
| BTA | 0.06 | 0.03 | 0.09 | 0.045 | 0.068 |
| PEG 4000 | 0.26 | 0.26 | 0.44 | | |
| Winog | 0.1 | 0.07 | 0.09 | 0.065 | 0.098 |
| Vivapur | | | 0.48 | 0.32 | 0.48 |
| Triacetate | | | 0.72 | | |
| Perfume | 0.02 | 0.02 | 0.01 | | |
| Total | 20.1 g | 19.84 g | 25.23 g | 21.05 g | 24.663g |
| Phase 2 | | | | | |
| FN3 | 0.29 | 0.499 | 0.29 | 0.499 | 0.499 |
| Termamyl | 0.29 | 0.29 | 0.29 | 0.29 | 0.29 |
| Citric acid | 0.23 | 0.1 | 0.23 | 0.1 | 0.1 |
| Bicarbonate | 0.62 | 0.289 | 0.62 | 0.289 | 0.289 |
| PEG 400 | 0.02 | 0.01 | 0.02 | 0.01 | 0.01 |
| PEG 4000 | 0.07 | 0.2 | 0.07 | 0.2 | 0.2 |
| PVPVI | | 0.095 | | 0.095 | 0.095 |
| Potassium Citrate | | 0.2 | | 0.2 | 0.2 |
| Total | 1.52g | 1.683g | 1.52 g | 1.683g | 1.683g |
| Organic solvent composition | | | | | |
| MEA | 10 | | 4 | 5 | 5 |
| MAE | | 10 | 4 | 5 | |
| SF1488 | | | 4 | | 5 |
| Total | 10 ml | 10 ml | 12 ml | 10 ml | 10 ml |

Examples 1 to 5 were repeated using the same automatic dishwashing detergent compositions but using an organic solvent composition comprising 10 ml of 2-amino-2-methyl-1-propanol and 2 ml of Silwet L7600. The compositions provided excellent removal of cooked-on, baked-on and burnt-on food soils.

Examples 6 to 10

Examples 6 to 10 illustrate the use of a combination of an automatic dishwashing liquid detergent and an organic solvent composition for removing cooked-, baked- and burnt-on soils. The two-component compositions of examples 6 to 10 are used to wash a load of cookware and tableware according to the procedure described hereinabove (Examples 1 to 5). 30 ml of the dishwashing detergent and the 10 ml of the solvent composition are separately delivered to the main-wash cycle of a 5 litre liquor capacity Bosch 6032 dishwashing machine, at 55° C. without prewash. The compositions of examples 6 to 10 provide excellent removal of cooked-on, baked-on and burnt-on food soils.

| Example | 6 | 7 | 8 | 9 | 10 |
|---|---|---|---|---|---|
| Dishwashing detergent composition | | | | | |
| KOH | 14.31 | 14.31 | 14.31 | 11.45 | 4.67 |
| H2SO4 | 11.26 | 11.26 | 11.26 | 9.00 | |
| STPP | 16.00 | 16.00 | 16.00 | 20.00 | |
| SKTP | | | | | 30.00 |
| 1,2-Propanediol | 0.50 | 0.50 | 0.50 | 0.5 | 6.00 |
| Boric acid | 3.00 | 3.00 | 3.00 | 3.0 | 4.00 |
| Polygel premix | 24.40 | 24.40 | 24.40 | 24.00 | 24.40 |
| PVPVI | 0.02 | | | | |
| SLF18 | 1.0 | | 1.0 | 1.00 | |
| $C_{16}$ AO | 0.6 | 0.6 | | 2.00 | 2.00 |
| ACNI | 0.3 | 0.3 | | | 3.00 |
| CaCl2 | 0.04 | 0.04 | 0.04 | 0.37 | 0.37 |
| Na benzoate | 0.61 | 0.61 | 0.61 | 0.61 | 0.61 |
| Proxel GXL | 0.05 | 0.05 | 0.05 | 0.05 | 0.05 |
| FN3 | 0.60 | 0.60 | 0.60 | 0.60 | 0.90 |
| Duramyl | 0.27 | 0.27 | 0.27 | | |
| Termamyl | 0.3 | | | 0.17 | 0.26 |
| Perfume | 0.1 | 0.1 | 0.2 | 0.1 | 0.1 |
| Dye | 0.4 | 0.4 | 0.3 | 0.24 | 0.64 |
| Water | | | to 100 | | |
| Organic solvent composition | | | | | |
| MEA | 100 | | 33 | 50 | 50 |
| MAE | | 100 | 33 | 50 | |
| SF1488 | | | 34 | | 50 |

Examples 6 to 10 were repeated using the same automatic dishwashing detergent compositions but using an organic solvent composition comprising 10 ml of 2-amino-2-methyl-1-propanol and 2 ml of Silwet L7600. The compositions provided excellent removal of cooked-on, baked-on and burnt-on food soils.

Examples 11 to 15

Examples 11 to 15 further illustrate the use of a combination of an automatic dishwashing liquid detergent and an organic solvent composition for removing cooked-, baked- and burnt-on soils. The two-component compositions of examples 11 to 15 are used to wash a load of cookware and tableware according to the procedure described hereinabove (Examples 1 to 5). The automatic dishwashing liquid detergent and the organic solvent composition are delivered in separate compartments of a unit dose (30 ml of the dishwashing detergent and the 10 ml of the solvent composition) partially hydrolysed PVA water-soluble pouch. The pouch is delivered to the main-wash cycle of a Bosch 6032 dishwashing machine, at 55° C. without prewash. The two-component compositions of examples 11 to 15 provide excellent removal of cooked-on, baked-on and burnt-on food soils. At the same time, they provide excellent compatibility with the PVA pouch material.

| Example | 11 | 12 | 13 | 14 | 15 |
|---|---|---|---|---|---|
| Dishwashing detergent composition | | | | | |
| KOH | 14.31 | 14.31 | 14.31 | 11.45 | 4.67 |
| H2SO4 | 11.26 | 11.26 | 11.26 | 9.00 | |
| STPP | 16.00 | 16.00 | 16.00 | 20.00 | |
| SKTP | | | | | 30.00 |
| 1,2-Propanediol | 0.50 | 0.50 | 0.50 | 0.5 | 6.00 |
| Boric acid | 3.00 | 3.00 | 3.00 | 3.0 | 4.00 |
| Polygel premix | 24.40 | 24.40 | 24.40 | 24.00 | 24.40 |
| PVPVI | 0.02 | | | | |
| SLF18 | 1.0 | | 1.0 | 1.00 | |
| $C_{16}$ AG | 0.6 | 0.6 | | 2.00 | 2.00 |
| ACNI | 0.3 | 0.3 | | | 3.00 |
| CaCl2 | 0.04 | 0.04 | 0.04 | 0.37 | 0.37 |
| Na benzoate | 0.61 | 0.61 | 0.61 | 0.61 | 0.61 |
| Proxel GXL | 0.05 | 0.05 | 0.05 | 0.05 | 0.05 |
| FN3 | 0.60 | 0.60 | 0.60 | 0.60 | 0.90 |
| Duramyl | 0.27 | 0.27 | 0.27 | | |
| Termamyl | 0.3 | | | 0.17 | 0.26 |
| Perfume | 0.1 | 0.1 | 0.2 | 0.1 | 0.1 |
| Dye | 0.4 | 0.4 | 0.3 | 0.24 | 0.64 |
| Water | | | to 100 | | |
| Organic solvent composition | | | | | |
| MEA | 50 | | 20 | 30 | 30 |
| MAE | | 50 | 20 | 30 | |
| Benzyl alcohol | 50 | 50 | 40 | 40 | 30 |
| SF1488 | | | 20 | | 40 |

Examples 1 to 5 were repeated using the same automatic dishwashing detergent compositions but using an organic solvent composition comprising 10 ml of 2-amino-2-methyl-1-propanol and 2 ml of Silwet L7600. The compositions provided excellent removal of cooked-on, baked-on and burnt-on food soils.

Examples 16 to 19

Examples 16 to 19 illustrate the use of a combination of an automatic dishwashing liquid detergent and an organic solvent composition for removing cooked-, baked- and burnt-on soils. The two-component compositions are stored in a dual-compartment bottle having an electrically operated pump and delivered at a feed ratio (dishwashing liquid detergent: organic solvent composition) of 3:1. The compositions of examples 16 to 19 are used to wash a dishware load according to the procedure described hereinabove (Examples 1 to 5). 30 ml of the dishwashing detergent and 10 ml of the solvent composition are separately delivered from the dual-compartment bottle to the main-wash cycle of a Bosch 6032 dishwashing machine, at 55° C. without prewash. The two-component compositions of examples 16 to 19 provide excellent removal of cooked-on, baked-on and burnt-on food soils. The above examples 16 to 19 were repeated using a dishwashing liquid detergent: organic solvent composition ratio of 4:1 with similar results.

| Example | 16 | 17 | 18 | 19 |
|---|---|---|---|---|
| Dishwashing detergent composition | | | | |
| STPP | 28.00 | 28.00 | 28.00 | 28.00 |
| KOH | 5.30 | 5.30 | 5.30 | 5.30 |
| Silicate 3.2 | 1.0 | 1.0 | 1.0 | 1.0 |
| Polygel DKP | 0.55 | 0.55 | 0.55 | 0.55 |
| SLF18 | 1.25 | | 1.25 | |
| $C_{16}$ AO | | 0.40 | | 0.40 |
| ACNI | | 3.00 | | 3.00 |
| Water | | to 100 | | |
| Organic solvent composition | | | | |
| MEA | 74.00 | | 37.00 | 37.00 |
| MAE | | 74.00 | 37.00 | 37.00 |
| PB1-50 | 18.5 | 18.5 | 18.5 | 18.5 |
| FN3 | 2.60 | 2.60 | 2.60 | 2.60 |
| Termamyl | 3.34 | 3.34 | 3.34 | 3.34 |
| Thickener | 1.56 | 1.56 | 1.56 | 1.56 |

Examples 20 to 24

Examples 20 to 24 illustrate "all-in-one" solvent-containing automatic dishwashing detergent compositions. The compositions of examples 20 to 24 are used to wash a dishware load following the procedure described hereinabove (Examples 1 to 5). 40 ml of the dishwashing composition are delivered to the main-wash cycle of a Bosch 6032 dishwashing machine, at 55° C. without prewash. The "all-in-one" compositions of examples 20 to 24 provide excellent removal of baked-on soils.

| Example | 20 | 21 | 22 | 23 | 24 |
|---|---|---|---|---|---|
| Dishwashing detergent solvent composition | | | | | |
| KOH | 4.60 | 5.65 | 2.10 | 1.47 | 1.05 |
| H2SO4 | 3.94 | 3.94 | | | |
| MEA | | 4.00 | | 4.00 | 8.00 |
| STPP | 22.00 | 22.00 | | 22.00 | 22.00 |
| SKTP | | | 30.00 | | |
| 1,2-Propanediol | 0.5 | 0.5 | 6.00 | 5.5 | 5.5 |
| Boric acid | 3.00 | 3.00 | 4.00 | 3.4 | 3.4 |
| Polygel premix | 1.18 | 1.18 | 1.18 | 1.18 | 1.18 |
| SLF18 | 1.0 | 1.0 | | | |
| ACNI | | | 3.0 | 2.1 | 2.1 |
| $C_{16}$ AO | | | 0.40 | 0.308 | 0.308 |
| CaCl2 | 0.2 | 0.2 | 0.22 | 0.2 | 0.2 |
| Na benzoate | 0.20 | 0.20 | 0.20 | 0.20 | 0.20 |
| Proxel GXL | 0.01 | 0.01 | 0.05 | 0.01 | 0.01 |
| FN3 | 0.60 | 0.60 | 0.90 | 0.76 | 0.76 |
| Duramyl | 0.27 | | | | |
| Termamyl | | 0.17 | 0.26 | 0.23 | 0.23 |
| Perfume | 0.10 | 0.10 | 0.10 | 0.10 | 0.10 |
| Dye | 0.0024 | 0.0024 | 0.0024 | 0.0024 | 0.0024 |
| Water | | | to 100 | | |

What is claimed is:

1. A method of removing cooked-, baked-, or burnt-on food soil from cookware and tableware comprising delivering a plurality of compositions including at least one organic solvent composition into the same or different cycles of an automatic dishwashing machine and washing the soiled cookware/tableware in the resulting solvent-containing wash liquor, wherein two of the plurality of compositions are delivered from a single storage means, separate storage means, or from separate zones of a multi-zone storage means, wherein the plurality of compositions is in the form of a multi-layer liquid or gel when delivered from the single storage means, and wherein the organic solvent composition comprises an organoamine solvent and glycol ether solvent in a weight ratio of from about 3:1 to about 1:3.

2. A method according to claim 1 wherein the plurality of compositions includes at least one organic solvent composition and at least one automatic dishwashing detergent composition, or wherein the plurality of compositions includes two or more solvent compositions.

3. A method according to claim 1 comprising delivering an organic solvent composition in the pre-wash cycle of an automatic dishwashing machine and thereafter delivering an automatic dishwashing detergent composition in the main-wash cycle of the automatic dishwashing machine.

4. A method according to claim 1 comprising delivering an organic solvent composition and a first automatic dishwashing detergent composition in the pre-wash cycle of an automatic dishwashing machine and thereafter delivering a second automatic dishwashing detergent composition in the main-wash cycle of the automatic dishwashing machine.

5. A method according to claim 1 comprising delivering an organic solvent composition and an automatic dishwashing detergent composition in the pre-wash and thereafter in the main-wash cycle of an automatic dishwashing machine.

6. A method according to claim 1 comprising delivering an organic solvent composition and an automatic dishwashing detergent composition in the main-wash cycle of an automatic dishwashing machine.

7. A method according to claim 1 comprising washing the cookware/tableware in the pre-wash cycle of an automatic dishwashing machine in the presence of an organic solvent composition and thereafter rinsing the cookware/tableware in the rinse cycle of the automatic dishwashing machine in the presence of an automatic dishwashing rinse composition.

8. A method according to claim 1 comprising delivering an organic solvent composition and an automatic dishwashing detergent composition from separate storage means into the same cycle of an automatic dishwashing machine.

9. A method according to claim 1 comprising delivering one or both of an organic solvent composition and an automatic dishwashing detergent composition contained in separate zones of a multi-zone storage means into the same or different cycles of an automatic dishwashing machine.

10. A method according to claim 9 comprising simultaneously delivering the organic solvent composition and automatic dishwashing detergent composition into the main wash cycle of the automatic dishwashing machine at a feed ratio (solvent composition: detergent composition) in the range from about 5:1 to about 1:50.

11. A method according to claim 9 comprising sequentially delivering the organic solvent composition and automatic dishwashing detergent composition into the pre-wash and main-wash cycles respectively.

12. A method according to claim 9 wherein the multi-zone storage means is a multi-compartment container and wherein the physical form of the organic solvent composition and/or automatic dishwashing detergent compositions is such as to prevent intimate mixing of the compositions prior to contact thereof with the wash liquor.

13. A method according to claim 1 comprising delivering separate portions of a multi-phase detergent composition into the same or different cycles of an automatic dishwashing machine, wherein the multi-phase detergent composition comprises at least a first phase containing an organic solvent composition and at least a second phase containing an automatic dishwashing detergent composition.

14. A method according to claim 1 comprising delivering a plurality of organic solvent compositions of different solvent characteristics into the same or different cycles of an automatic dishwashing machine.

15. A method according to claim 14 comprising delivering a first organic solvent composition into the pre-wash cycle of the automatic dishwashing machine and a second organic solvent composition into the main wash cycle of the automatic dishwashing machine, and wherein the first and second organic solvent compositions have differing soil and/or substrate specificities.

16. A method according to claim 14 comprising delivering a first organic solvent composition and a first automatic dishwashing detergent composition in the pre-wash cycle and a second solvent composition and a second automatic dishwashing detergent composition in the main-wash cycle of the automatic dishwashing machine.

17. A method according to claim 1 wherein the wash liquor concentration of organic solvent is in the range from about 100 ppm to about 10,000 ppm.

18. A method according to claim 1 wherein the wash liquor concentration of organic solvent is in the range from about 500 ppm to about 5,000 ppm.

19. A method according to claim 1 wherein the wash liquor has a liquid surface tension of less than about 35 mN/m and a pH of at least about 10.5.

20. A method according to claim 19 wherein the wash liquor has a liquid surface tension of less than about 30 mN/m and a pH of at least about 10.5.

21. A method according to claim 20 wherein the wash liquor has a liquid surface tension of less than about 32 mN/m and a pH of at least about 11.

22. A method according to claim 1 wherein the organic solvent composition is in a unit dose form adapted to provide controlled, delayed, sustained, triggered or slow release of organic solvent during one or more repeated washing cycles.

23. A method according to claim 1 wherein the organic solvent composition is in a unit dose form adapted to provide delayed release of organic solvent until after the pre-wash cycle of the dishwashing machine.

24. A method according to claim 1 wherein the organic solvent composition is in the form of a liquid, paste, cream or gel packaged in a single- or multi-compartment pouch, or absorbed onto a porous carrier material.

25. A method according to claim 1 wherein the organoamine solvent is effective in removing the soil and has a liquid surface tension of less than about 24.5 mN/m.

26. A method according to claim 25 wherein the organic solvent composition additionally comprises a spreading auxiliary selected from organic solvents, wetting agents and mixtures thereof.

27. A method according to claim 26 wherein the spreading auxiliary has a liquid surface tension of less than about 30 mN/m.

28. A method according to claim 27 wherein the spreading auxiliary has a liquid surface tension of less than about 26 mN/m.

29. A method according to claim 1 wherein the organic solvent composition has an advancing contact angle on a polymerised grease-coated glass substrate of less than 20° and for mixed solvent systems has an advancing contact angle that is less than the contact angle of any of the corresponding compositions containing the individual components of the solvent system.

30. A method according to claim 29 wherein the organic solvent composition has an advancing contact angle on a polymerised grease-coated glass substrate of less than 10°, and for mixed solvent systems has an advancing contact angle that is less than the advancing contact angle of any of the corresponding compositions containing the individual components of the solvent system.

31. A method according to claim 1 wherein the organic solvent system has a liquid surface tension of less than about 27 mN/m, or wherein the organic solvent system comprises a plurality of solvent components in levels such that the solvent system has a surface tension less than that of any of the individual solvent components.

32. A method according to claim 31 wherein the organic solvent system has a liquid surface tension of less than about 27 mN/m, or wherein the organic solvent system comprises a plurality of solvent components in levels such that the solvent system has a surface tension at least 1 mN/m less than that of any of the individual solvent components.

33. A method according to claim 32 wherein the organic solvent system has a liquid surface tension of less than about 25 mN/m, or wherein the organic solvent system comprises a plurality of solvent components in levels such that the solvent system has a surface tension at least 1 mN/m less than that of any of the individual solvent components.

34. A method according to claim 1 wherein the organic solvent further comprises a solvent selected from the group consisting of alcohols, amines, esters, glycol ethers, terpenes and mixtures thereof.

35. A method according to claim 34 wherein the organic solvent is selected from organoamine solvents, alcoholic solvents, glycols and glycol derivatives and mixtures thereof.

36. A method according to claim 1 wherein the glycol ether solvent is selected from ethylene glycol monobutyl ether, diethylene glycol monobutyl ether, ethylene glycol monomethyl ether, ethylene glycol monoethyl ether, diethylene glycol monomethyl ether, diethylene glycol monomethyl ether, propylene glycol monobutyl ether, dipropylene glycol monobutyl ether, ethylene glycol phenyl ether and mixtures thereof.

37. A method of removing cooked-, baked-, or burnt-on food soil from cookware and tableware comprising delivering a plurality of compositions including at least one organic solvent composition into the same or different cycles of an automatic dishwashing machine and washing the soiled cookware/tableware in the resulting solvent-containing wash liquor, wherein the organic solvent comprises an organoamine solvent and glycol ether, in a weight ratio of from about 3:1 to about 1:3, and wherein the glycol ether is a mixture of diethylene glycol monobutyl ether and propylene glycol butyl ether in a weight ratio of from about 1:2 to about 2:1.

38. A method according to claim 1 wherein the organoamine solvent has a pKa of at least 8.8.

39. A method according to claim 38 wherein the organoamine solvent has a pKa of at least 9.8.

40. A method according to claim 1 wherein the organic solvent comprises a mixture of a first organoamine solvent having a pKa of 9.5 or less and a second organoamine solvent having a pKa greater than 9.5.

41. A method according to claim 1 wherein the organic solvent comprises one or more organoamines which is/are introduced into the wash liquor of an automatic dishwashing machine in the form of their ammonium salt at a wash liquor pH above the highest pKa of the organoamine/s.

42. A method according to claim 1 wherein the organic solvent is used in conjunction with a wetting agent effective in lowering the surface tension of the solvent, the wetting agent being selected from organic surfactants having a surface tension less than about 30 mN/m.

43. A method according to claim 42 wherein the organic solvent is used in conjunction with a wetting agent effective in lowering the surface tension of the solvent, the wetting agent being selected from organic surfactants having a surface tension less than about 26 mN/m.

44. A method according to claim 43 wherein the wetting agent is selected from silicone polyether copolymers.

45. A method according to claim 1 wherein the organic solvent has a volatile organic content above 1 mm Hg of less than about 50%.

46. A method according to claim 45 wherein the organic solvent has a volatile organic content above 1 mm Hg of less than about 10%.

47. A method according to claim 1 wherein the organic solvent is essentially free of solvent components having a boiling point below about 150° C., flash point below about 100° C. or vapor pressure above about 1 mm Hg.

48. A method according to claim 1 wherein the organic solvent system further comprises a solvent selected from:

(a) polar, hydrogen-bonding solvents having a Hansen solubility parameter of at least 20 $(Mpa)^{1/2}$, a polarity parameter of at least 7 $(Mpa)^{1/2}$ and a hydrogen bonding parameter of at least 10 $(Mpa)^{1/2}$;

(b) polar non-hydrogen bonding solvents having a Hansen solubility parameter of at least 20 $(Mpa)^{1/2}$, a polarity parameter of at least 7 $(Mpa)^{1/2}$ and a hydrogen bonding parameter of less than 10 $(Mpa)^{1/2}$, (c) amphiphilic solvents having a Hansen solubility parameter below 20 $(Mpa)^{1/2}$, a polarity parameter of at least 7 $(Mpa)^{1/2}$ and a hydrogen bonding parameter of at least 10 $(Mpa)^{1/2}$, (d) non-polar solvents having a polarity parameter below 7 $(Mpa)^{1/2}$ and a hydrogen bonding parameter below 10 $(Mpa)^{1/2}$, and (e) mixtures thereof.

49. A method of removing cooked-, baked-, or burnt-on food soil from cookware and tableware comprising delivering an organic solvent composition and a first automatic dishwashing detergent composition in the pre-wash cycle of an automatic dishwashing machine and thereafter delivering a second automatic dishwashing detergent composition in the main-wash cycle of the automatic dishwashing machine and washing the soiled cookware/tableware in the resulting solvent-containing wash liquor; wherein the organic solvent comprise organoamine solvent and glycol ether solvent, in a weight ratio of from about 3:1 to about 1:3; wherein the organoamine solvent is selected from monoethanolamine, monoisopropanolamine, diethylethanolamine, ethyl diethanolamine, beta-aminealkanols, diethanolamine, disopropanolamine, 2-(methylamino)ethanol, triethanolamine, triispopropanolamine, and mixtures thereof; and wherein the glycol ether solvent is selected from ethylene glycol monobutyl ether, diethylene glycol, monobutyl ether, ethylene glycol monomethyl ether, ethylene glycol monoethyl ether, diethylene glycol monomethyl ether, diethylene glycol monoethyl ether, propylene glycol monobutyl ether, dipropylene glycol monobutyl ether, ethylene glycol phenyl ether, and mixtures thereof.

* * * * *